United States Patent [19]

Scholey

[11] Patent Number: 4,544,094

[45] Date of Patent: Oct. 1, 1985

[54] MEANS FOR JOINING TOY TRACK SECTIONS

[75] Inventor: Michael F. Scholey, Hollywood, Calif.

[73] Assignee: Mattel, Inc., Hawthorne, Calif.

[21] Appl. No.: 533,314

[22] Filed: Sep. 19, 1983

[51] Int. Cl.[4] ..... A63H 18/02; E01B 23/00

[52] U.S. Cl. ..... 238/10 R; 238/10 F

[58] Field of Search ..... 238/10 R, 10 A, 10 B, 238/10 C, 10 E, 10 F; 104/53, 60, 69, 304, 305, DIG. 1; 198/823, 822; 404/41, 50

[56] References Cited

U.S. PATENT DOCUMENTS

| | | | |
|---|---|---|---|
| Re. 30,454 | 12/1980 | Birdsall | 238/10 F |
| 2,120,251 | 6/1938 | Johnson | 238/10 |
| 2,565,359 | 8/1951 | Dubilier | 238/10 |
| 3,463,393 | 8/1969 | Fischer | 238/10 |
| 3,592,384 | 7/1971 | Tomaro | 238/10 E |
| 3,597,876 | 8/1971 | Haji | 46/202 |
| 3,620,045 | 11/1971 | Richter | 238/10 E |
| 3,680,777 | 8/1972 | Arai | 238/10 E |
| 3,750,945 | 8/1973 | Warr | 238/10 E |
| 3,830,426 | 8/1974 | Martin | 238/10 F |
| 4,106,695 | 8/1978 | Carella et al. | 238/10 F |
| 4,179,066 | 12/1979 | Teter | 238/10 F X |
| 4,241,875 | 12/1980 | Vandenbrink | 238/10 R X |
| 4,286,752 | 9/1981 | Cheng | 238/10 F |
| 4,449,665 | 5/1984 | Goldfarb et al. | 238/10 R |

*Primary Examiner*—Randolph A. Reese

*Attorney, Agent, or Firm*—Ronald M. Goldman; Melvin A. Klein

[57] ABSTRACT

A track system for toy vehicles formed from a plurality of like interconnectable track sections, each section having a main body portion with upwardly disposed opposing sidewall portions, opposite ends of the sidewall portions and main body portion having sets of projections configured and dimensioned for interlocking engagement with like track sections. Hook members are integrally formed in the main body portion on opposite ends of the longitudinal centerline thereof for interlocking engagement. Each track section is preferably formed in a planar configuration with reduced cross sectional areas defining hinge sections for enabling pivoting of the sidewall portions into transverse relation relative to the main body portion. Regions on opposite sides of the hinge section are configured for interlocking to maintain the positions of the sidewall portions.

13 Claims, 10 Drawing Figures

MEANS FOR JOINING TOY TRACK SECTIONS

DESCRIPTION

1. Technical Field

This invention relates to a track system for a toy vehicle, and more particularly to a track section interconnectable with a number of like track sections to form a roadway for travel thereon of a miniature toy vehicle.

In toy vehicle tracks formed of a number of sections, it is preferable that such sections have some flexibility to permit the formation of curves and banks.

2. Background Art

Track assemblies employing interconnectable like track sections are widely employed for toy vehicles such as toy trains and toy vehicles, motorized as well as nonmotorized. One such track assembly is shown in U.S. Pat. No. 2,120,251, issued to Johnson on June 14, 1938, the track assembly being for toy trains and including sections having the tracks thereof formed of sheet metal sections flexibly telescoped together to enable forming of curves.

Another train track assembly is shown in U.S. Pat. No. 2,565,359, issued to Dubilier on Aug. 21, 1951, the track assembly including rails for trains, the rails being formed with transversely extending slots to permit flexing upon assembly.

U.S. Pat. No. 3,463,393, issued Aug. 26, 1969 to Fischer discloses a train track system having H-shaped rail members with centrally located specially configured openings for connection to cross-tie members.

Another train track system is disclosed in U.S. Pat. No. 3,592,384, issued to Tomaro on July 13, 1971. The track sections are of unitary molded construction with molded flanges extending longitudinally from the track sections to interlock with flange receiving recesses in adjoining sections.

U.S. Pat. No. 3,597,876, issued Aug. 10, 1971 to Haji for a toy roadway set for a toy car, the set having track sections with hooklike joints for interconnection.

U.S. Pat. No. 3,620,451 to Richter issued on Nov. 16, 1971, discloses a model railway track having a connector with multiple projections at opposite ends thereof for enabling gripping of the underside of track sections at different distances.

U.S. Pat. No. 3,680,777, issued Aug. 1, 1972 to Arai, discloses a track system for use with a toy train or the like, the system including a plurality of pliable bed sections and a pair of pliable rails for enabling the forming of curves or slopes.

A track for toy autos is shown in U.S. Pat. No. 3,750,945, issued Aug. 7, 1973 to Warr, the track being formed of track pieces configured for alternate underlapped and overlapped supporting relationship, with the lapped portion including pivot means to permit relative adjustment between adjoining sections to form curves.

Another model vehicle race track is disclosed in U.S. Pat. No. 3,830,426, the track sections being interconnected by means of a single hook and a single corresponding opening on each end of the track section for engagement with like elements of a like track section by the application of lateral force.

A toy vehicle track is disclosed in U.S. Pat. No. 4,106,695, issued Aug. 15, 1978 to Carella et al, the adjacent track sections being interconnected by one section having longitudinally extending generally wedge-shaped projections, with the interacting end of the adjacent section having complementarily formed wedge-shaped recesses.

DISCLOSURE OF INVENTION

In accordance with the present invention, there is provided a track system for toy vehicles, the system being formed of interconnectable like track sections.

Each track section is a unitary member formed in a generally planar configuration with a main body portion and first and second sidewall portions on the lateral ends thereof, with reduced cross-section hinge portions. The hinge portions enable pivoting of the sidewall portions to a direction generally transverse to the plane of the main body portion. The lower edge of each sidewall portion and the adjacent edge of the main body portion have matingly interlocking means for maintaining the sidewall portions in the erected position. A plurality of sets of projections extend longitudinally from opposite sides of the sidewall portions and the main body portion, the sets being configured and arranged for interlocking with like sets on adjoining track sections. Some of the projections are provided with serrated surfaces and barbs for providing friction to maintain adjoining sections together. Coupling means in the form of hook members are formed generally centrally in opposite edges of the main body portion for interlocking engagement. The section is formed of generally flexible material and the projections are of sufficient depth to permit pivoting of one section relative to the next, for forming curves and banks and loops.

BRIEF DESCRIPTION OF THE DRAWINGS

The details of the invention will be described in connection with the accompanying drawings, in which like reference numerals refer to like elements in the several views:

FIG. 9 is an enlarged top plan view of the track section of FIG. 5 interconnected to other like sections; and FIG. 10 is a top plan view of a number of the track sections of FIG. 5 interconnected to form a curve with the sidewalls unpivoted for purpose of illustration and explanation.

BEST MODE FOR CARRYING OUT THE INVENTION

Figure 1:
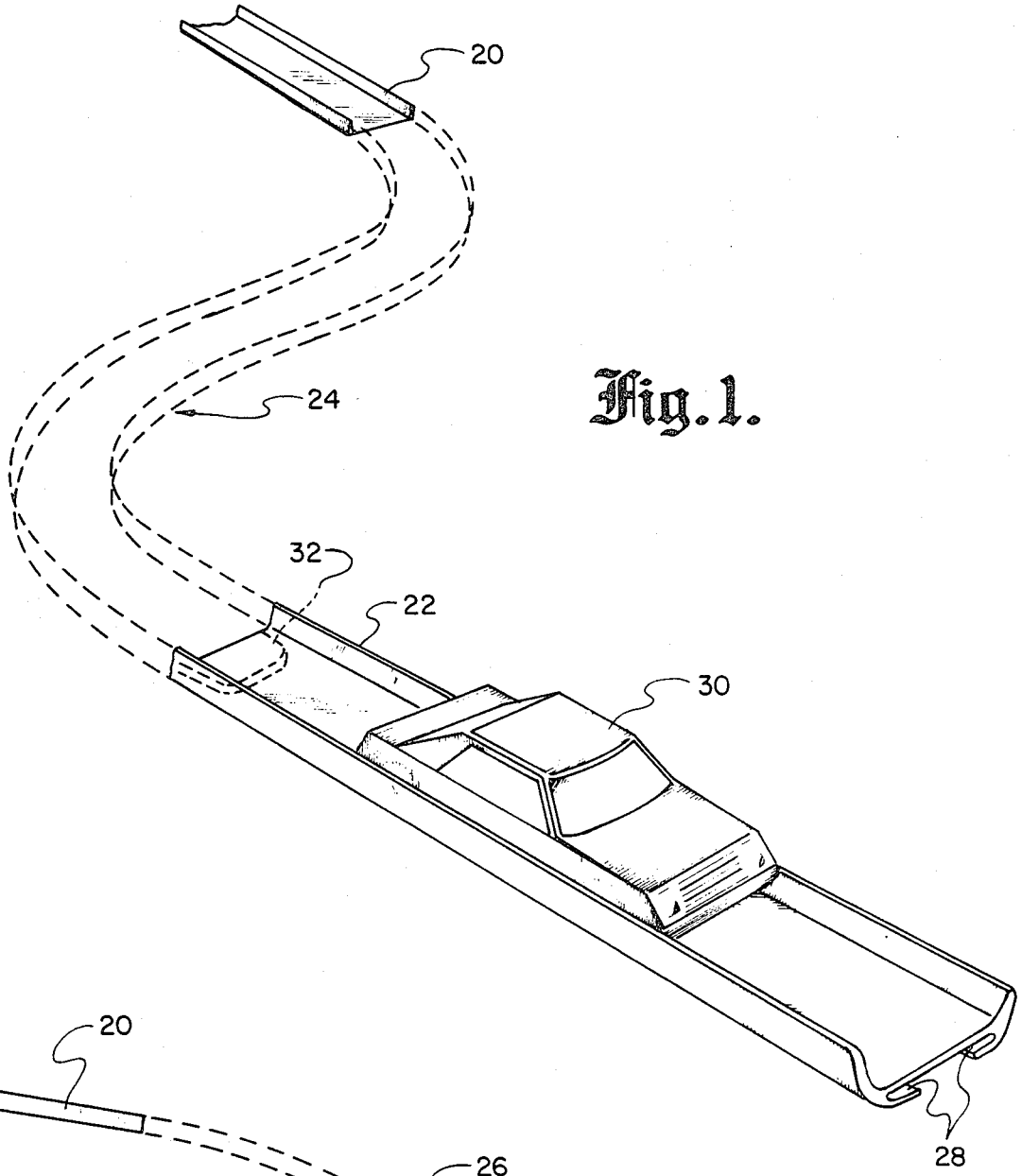
FIG. 1 is a perspective view of a track segment, with a portion thereof in dotted lines depicting a curve which may be formed from the track sections of the present invention.
Figure 2:
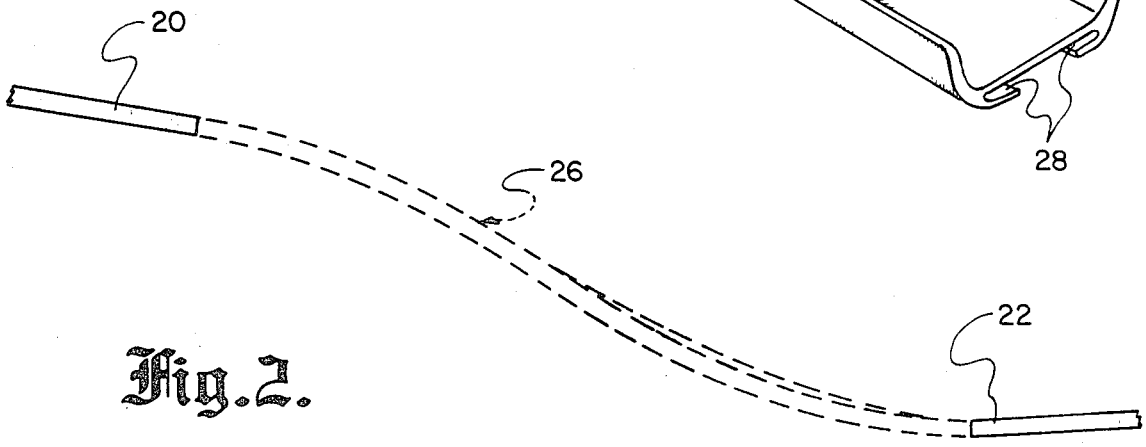
FIG. 2 is a side elevation of a track segment, with a portion thereof in dotted lines depicting a slope which may be formed from the track sections of the present invention.

Referring now to the drawings, and particularly to FIGS. 1 and 2, there is shown a track system, including first and second conventional track sections 20 and 22, interconnected by a segment 24, shown in dotted lines, in FIG. 1, and a segment 26, shown in dotted lines in FIG. 2, the track system being configured for forming a roadway for passage thereover of a toy vehicle 30. The vehicle 30 is of the non-motorized free-wheeling type, such as those toy vehicles sold under the trademark "Hot Wheels".

The track sections 20 and 22 are one-piece members having sidewalls along the length thereof, with the undersurface having integrally formed longitudinally extending inwardly facing opposed grooves 28 configured for receiving tongue-shaped connectors therein for interconnecting like track sections. As shown in FIG. 1, the dotted line track segment 24 is in the form of an S-shaped curve, this being illustrative of the type of segment which can be formed using the track sections to be described. Similarly, the dotted line segment in FIG. 2 is in the form of an incline or slope. As will be hereinafter described, the segments 24 and 26 are structured using two basic track sections, one track section being interconnectable to other like track sections on either end thereof, and the other track section being configured for the transition to the conventional track sections 20 and 22. As shown in FIG. 1 the near end of the dotted line segment 24 is connected by a tongue member 32 (shown in dotted lines) to the conventional track section 22, this tongue member 32 being formed as a part of the transition section.

Figure 3:
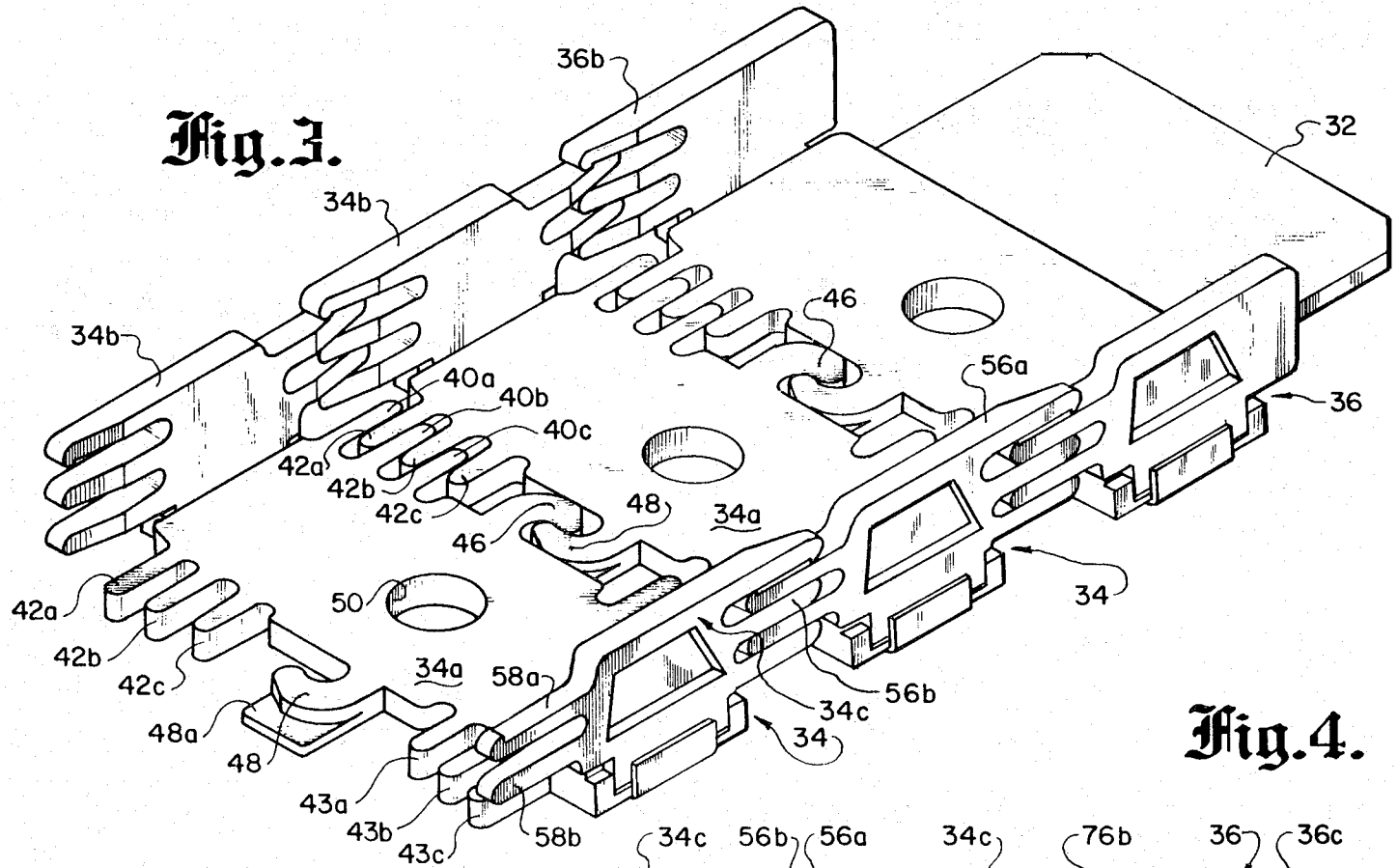
FIG. 3 is a perspective view of a track segment formed from the track sections according to the invention.
Figure 4:
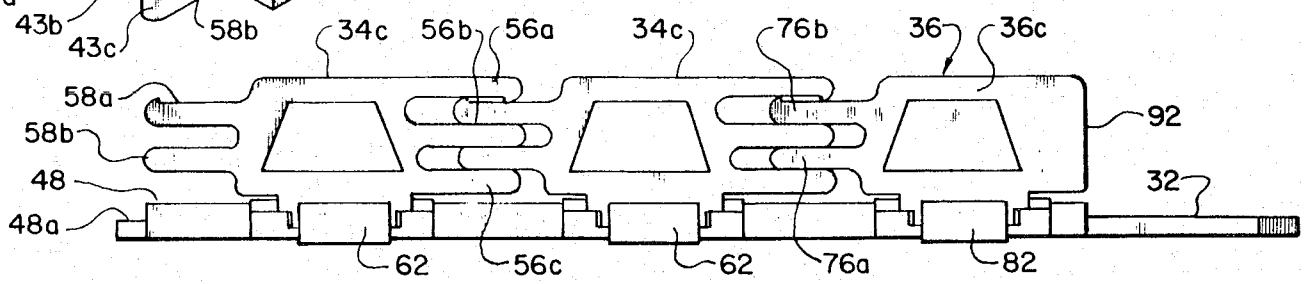
FIG. 4 is a side elevational view of the track segment of FIG. 3.

Referring now to FIGS. 3 and 4, there is shown a perspective, and side view of a track segment including two of the basic sections 34 and an end, or transition section 36. As will be discussed, the track sections 34 and 36 are formed as unitary members, that is, in one piece of generally planar form with integrally formed hinge means for enabling pivoting of sidewall portions relative to a main body portion, with interlock means at the hinge junction, with integrally formed interconnection, or coupling means.

Each of the track sections 34 includes a main body portion, generally designated 34*a*, with a pair of oppositely disposed, generally parallel, generally upright sidewalls 34*b* and 34*c*. Similarly, the transition track section 36 has a main body portion 36*a* with sidewalls 36*b* and 36*c* on the lateral ends thereof. In addition to coupling means for interconnecting the section 36 to the section 34, the transition section 36 includes an integrally formed tongue member 32 (shown in dotted lines in FIG. 1) for connection to conventional track sections 20 and 22.

By reference to FIGS. 3 through 6, the details pertaining to the basic track section 34 will now be described. For orientation purposes, and for ease of discussion, the direction coinciding with the path of travel of the vehicle on the roadway to be formed will be referred to as the longitudinal direction in describing the track sections; and the direction between sidewalls will be referred to as the lateral direction. The main body portion 34*a* has formed therein four sets of longitudinally extending fingerlike projections, designated sets 40–43, with sets 40 and 41 lying on one side of the lateral centerline, and sets 42 and 43 on the other side, with the fingers of one pair of sets offset from the fingers of the other pair of sets, in the lateral direction the distance of the width of one of the fingers. This offset enables the interleaving of the sets of projections on adjacent sections as shown in FIGS. 3 and 4.

On the longitudinal centerline of the main body portion 34*a* are integrally formed opposed hook members 46 and 48, each having a generally identical configuration, with the hook members being configured for coupling to a hook member of an adjacent track section 34 (or 36) to allow a limited amount of pivoting therebetween. Each hook member 46 and 48 includes a generally planar recessed support surface 46*a* and 48*a*, respectively, these surfaces acting as bearing surfaces for the hook member resting thereon (see also FIGS. 9 and 10). The upper surfaces of the hook members 46 and 48, as well as the upper surfaces of the main body portion 34*a* and the sets 40–43 of projections lie in a common plane, this being the plane of the roadway to be formed. Centrally disposed in the main body portion 34*a* is an aperture 50 which enables the user to pass therethrough suitable fastening means, such as a brad or the like, for securing the track section to a base if desired.

Figures 5, 6:
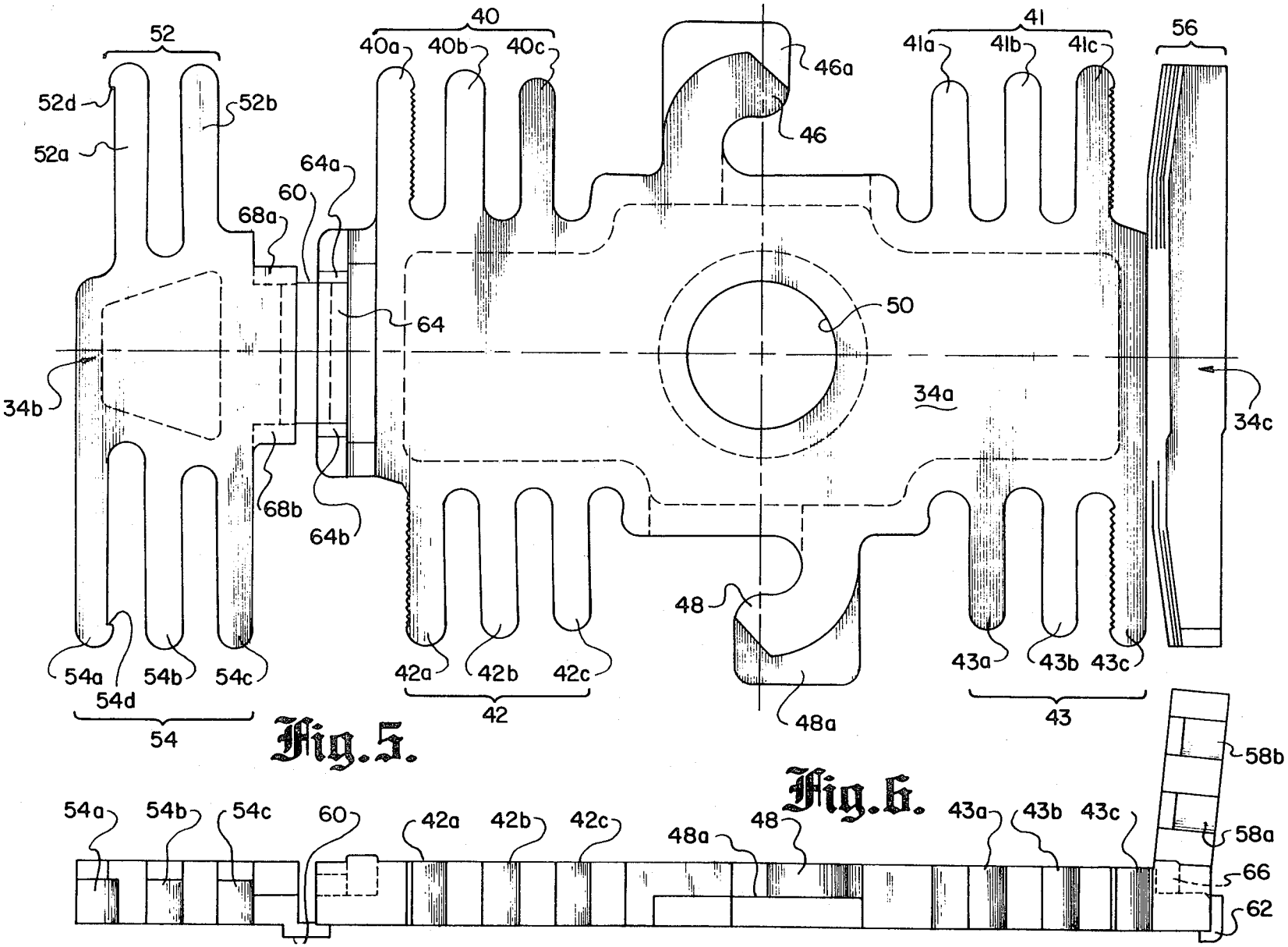
FIG. 5 is a top plan view of one of the track sections according to the invention, with a sidewall thereof pivoted.
FIG. 6 is a front view of the track section of FIG. 5.

In FIGS. 5 and 6, the finger-like projections of the sets 40–43 have been designated with letter suffix designations, such as projections 40*a*, 40*b* and 40*c* of set 40, the letter designations reading from left to right as viewed in the drawings. As can be seen, each projection is parallel to the next, with the space therebetween generally equal to the width of one projection. The outer projections, such as projections 40*a*, 41*c*, 42*a* and 43*c* have at least one side surface thereof serrated, the serrated surface of one projection coacting with the serrated surface of another projection of a like section on interleaving to assist in maintaining the interconnected sections in position. For example, as viewed in FIG. 5 projection 41*c* is serrated on the right side thereof, with projection 43*c* serrated on the left side thereof. With the projections of two track sections 34 interleaved, the serrated surface of projection 41*c* would coact with the serrated surface of projection 43*c*. Similarly, and simultaneously, the serrated surface of projection 40*a* would coact with the serrated surface of projection 42*a*. By reference to FIGS. 3 and 4, two track sections 34 are shown in the assembled position with the sets 40 and 41 interleaved with the projections of sets 42 and 43 of an adjacent section, with the hook members 46 and 48 coupled together. In these figures, the sidewalls 34*b* and 34*c* are shown in the pivoted and interlocked positions to define the roadway which extends over the main body portion 34*a*.

Referring again to FIGS. 5 and 6, the left sidewall 34*b* is shown in its normally flat position, while the right sidewall 34*c* is shown in its assembled ready-for-use position, that is an approximately right angle to the plane of the main body portion 34*a*. Each of the sidewalls 34*b* and 34*c* is provided with sets of finger-like projections, such as sets 52 and 54 of sidewall 34*b* and sets 56 and 58 of sidewall 34*c*. The projections of each set extend in a longitudinal direction, with the projections of one set on a sidewall being offset from the projections of the other set on the same sidewall a distance sufficient to permit the projections of an adjacent track section to be interleaved therein. For example, the set 52 includes two projections 52*a* and 52*b*, while the opposing set 54 includes three projections 54*a*, 54*b* and 54*c*. Similarly, the set 56 of sidewall 34*c* includes three projections 56*a*, 56*b* and 56*c* (See FIGS. 3 and 4), while the opposing set includes only two projections 58*a* and 58*b*. Upon interleaving of the projections of the sidewalls, for example, projection 52*a* with projection 54*a*, as shown in FIG. 5, each of these projections is provided with a barb 52*d* and 54*d*, respectively, with the barbs in facing relation upon connection. The interconnected position is shown in FIGS. 5 and 6. The barbs provide a means of limiting the pivoting of adjacent sections during the formation of curves.

Hinge means and interlock means are integrally formed in the track section 34 at the junction between the main body portion 34*a* and the sidewalls 34*b* and 34*c*. The hinge means take the form of a reduced cross-sectional hinge strap 60 between sidewall 34*b* and main body portion 34*a* (shown in its unflexed condition) and strap 62 between main body portion 34*a* and sidewall 34*c* (shown in its pivoted or flexed position). The track section 34 is formed in one-piece of a suitable plastic material which has rigidity and flexibility. Adjacent opposite lateral edges of the main body portion, there are formed pockets or recesses 64 and 66, only recess 64, of which, is shown in detail, it being understood that recess 66 is structurally and functionally identical. The recess 64 is generally elongate with inwardly extending shoulders 64*a* and 64*b* at the periphery of the main body portion 34*a*, these shoulders being in alignment along a line parallel to the hinge line. In parallel therewith and integrally formed on the sidewall 34*b* there are aligned opposing flange portions 68*a* and 68*b*, the distance from end to end thereof being generally equal to the length of the recess 64 for being received therein. The lateral dimension of the adjacent portion of the sidewall 34*a* beneath the flanges 68*a* and 68*b* is generally equal to the distance between the shoulders 64*a* and 64*b*. Upon pivoting of the sidewall 34*b* to the upright position about the hinge strap 60, the parts are interlocked by means of the flanges 68*a* and 68*b* resiliently deflecting upon pivoting over the shoulders 64*a* and 64*b*, respectively, until the flanges 68*a* and 68*b* rest within the recess 64 with the rear surfaces of the flanges 68*a* and 68*b* held captive in engagement with the shoulders 64*a* and 64*b* urging thereagainst.

Figures 7, 8:
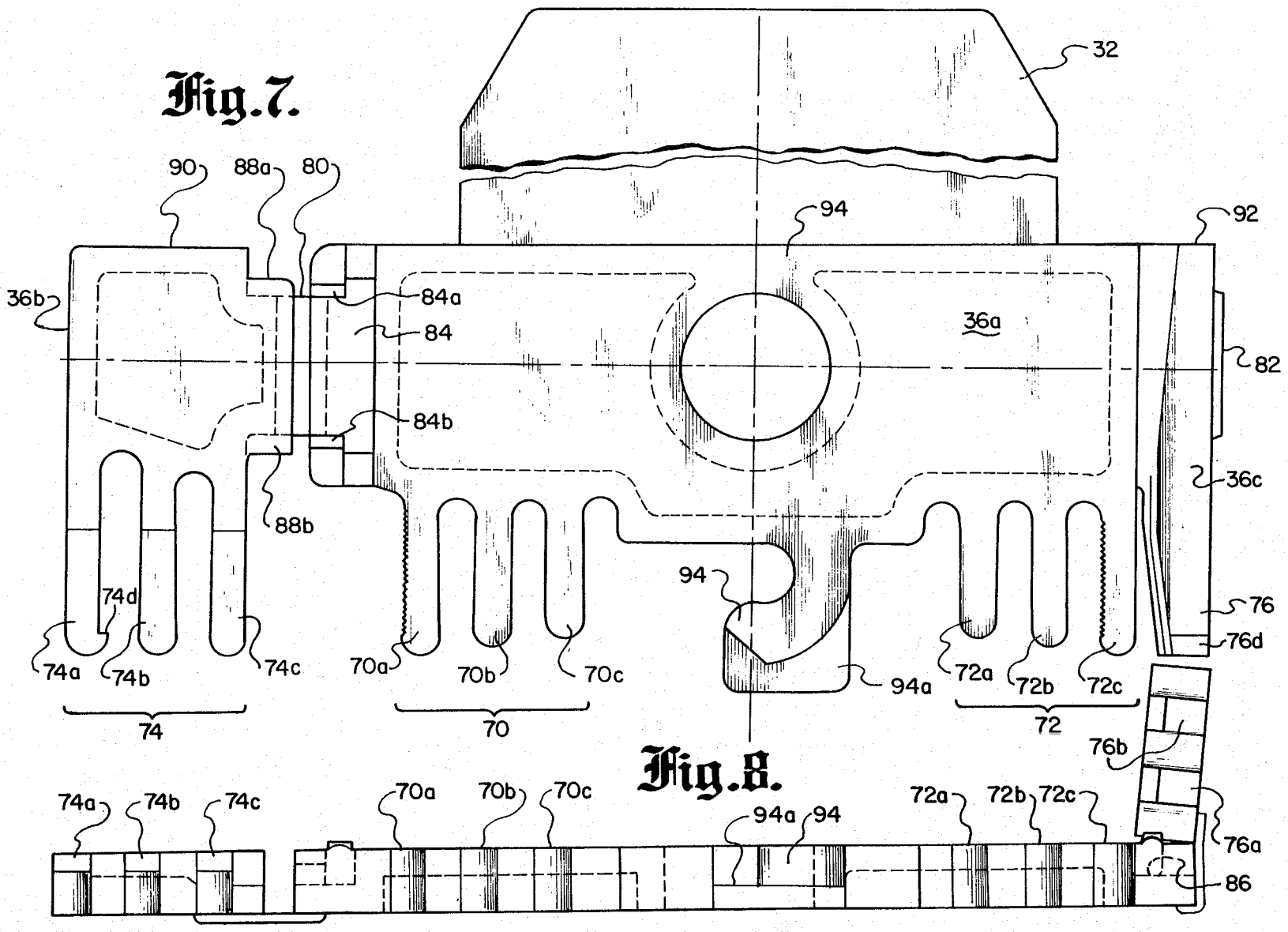
FIG. 7 is a top plan view of another of the track sections according to the invention, with a sidewall thereof pivoted.
FIG. 8 is a front view of the track section of FIG. 7.
Figure 4:
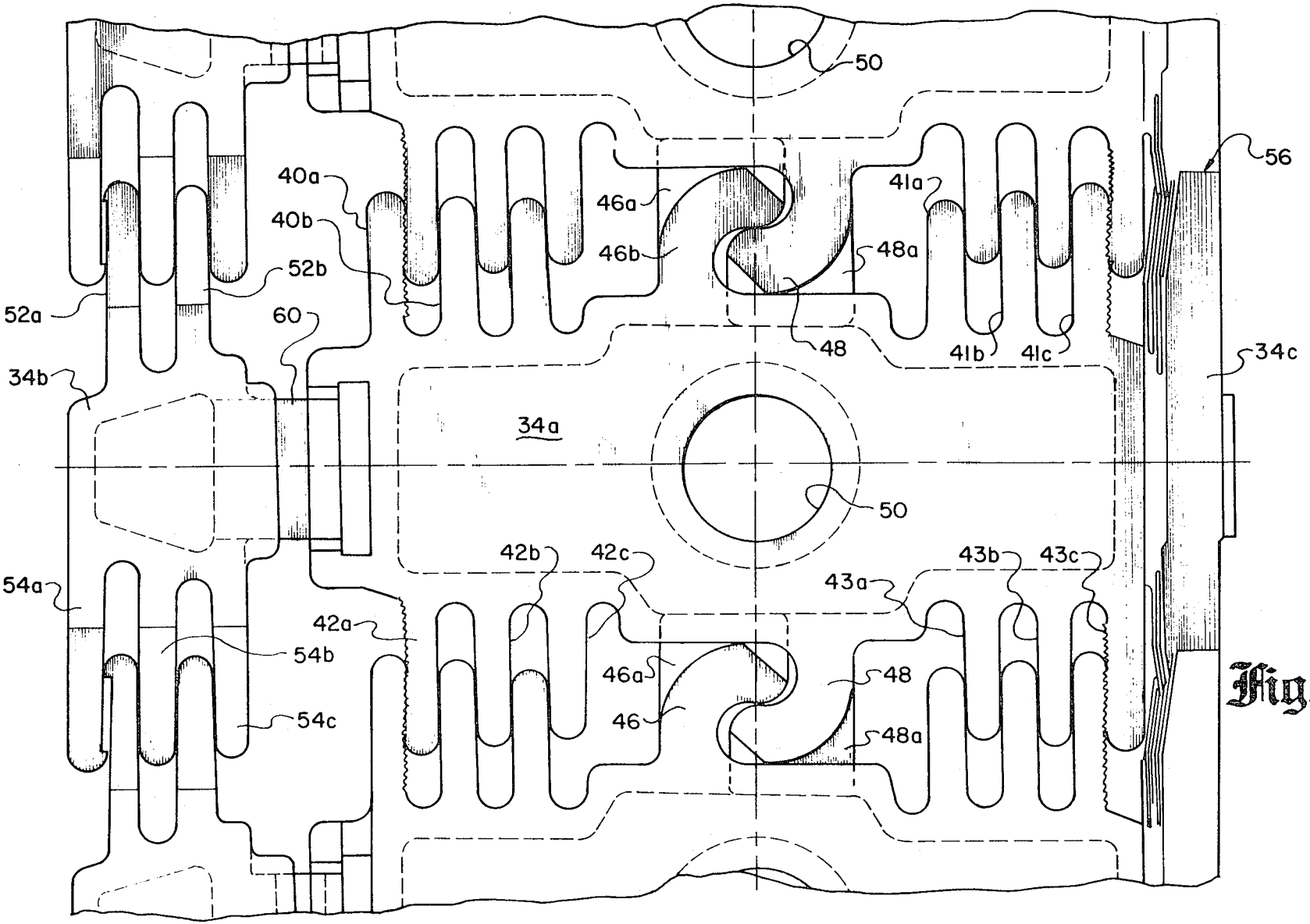
Figure 11:
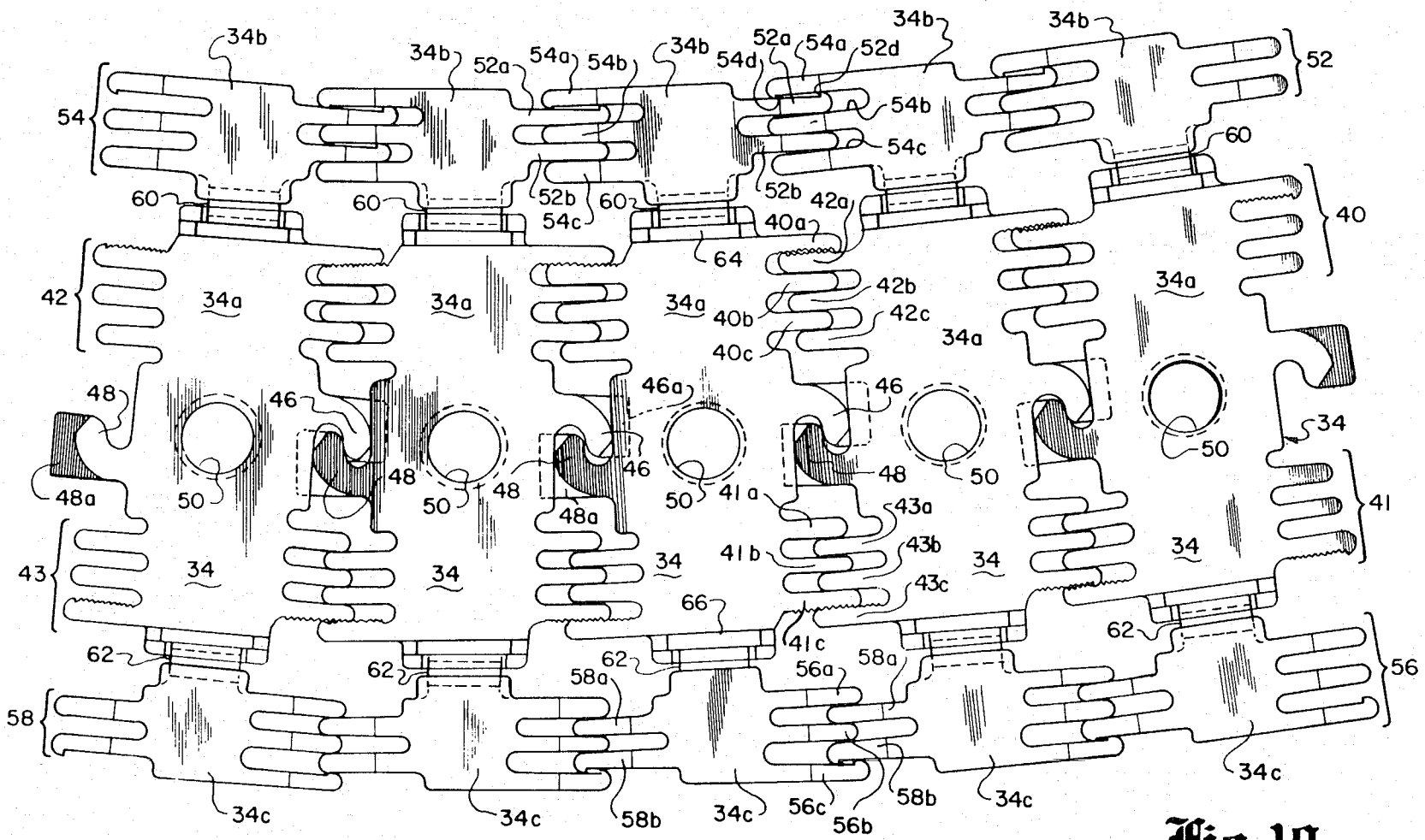

Referring now to FIGS. 7 and 8, the transition track section 36 will now be described. The track section 36 includes a main body portion 36*a* having first and second sets of longitudinally extending finger-like projections 70 and 72 on one side of the lateral center line with a tongue member 32 extending from the opposite side thereof. The projections 70*a*, 70*b* and 70*c* are structurally and functionally identical to the projections 42*a*, 42*b* and 42*c*, respectively of the set 42 of track section 34. Similarly, the projections 72*a*, 72*b* and 72*c* are functionally and structurally identical to the projections 43*a*, 43*b* and 43*c*, respectively of set 43 of track section 34.

The sidewalls 36*b* and 36*c*, similar to the sidewalls 34*b* and 34*c*, are hinged by straps 80 and 82 with interlock means provided by the recesses 84 and 86 with the shoulders 84*a* and 84*b* coacting with flanges 88*a* and 88*b*, the recesses, shoulders and flanges being structurally and functionally identical to the like parts of track section 34. As a point of difference, the sidewalls 36*b* and 36*c* are each provided with only one set 74 and 76, respectively, of finger-like projections, with set 74 having three projections 74*a*, 74*b* and 74*c*, while the set 76 has two projections 76*a* and 76*b*. These two sets 74 and 76 of projections generally correspond to the sets 54 and 58 of track section 34. The outer projections of sets 74 and 76 are likewise provided with barbs 74*d* and 76*d* on projections 74*a* and 76*b*, in an orientation for coaction with a like barb on an interconnected section. The opposite edges 90 and 92 of sidewalls 36*b* and 36*c* are straight for enabling abutting relation with the sidewalls of a conventional track section, such as track section 20 or 22. Similarly, the edge 94 of main body portion 36*a* from which tongue 32 extends, is straight for matching up to an adjacent edge of a conventional track section. The tongue 32 is generally planar and lies in a plane slightly recessed from the plane of the upper surface of the main body portion 36*a*, this recess being of a distance generally equal to the depth of the roadway portion of the conventional track section 20 or 22.

A single hook member 94 is provided along the same side of the main body portion 36*a* which contains the sets 70 and 72 of projections, the hook member 94 having a recessed planar bearing surface 94*a* formed integrally therewith. The hook member 94 and the surface 94*a* are functionally and structurally identical to the hook member 48 with its surface 48*a*.

The means for interlocking the sidewalls 36*b* and 36*c* to the main body portion 36*a* include the recess 84 with the inwardly projecting shoulder portions 84*a* and 84*b* for engaging the flanges 88*a* and 88*b* of the sidewall 36*b* upon pivoting thereof about the hinge 80. Similarly sidewall 36*c* is pivoted about hinge 82 thereof for engagement with the recess 86, which would be similarly configured. The interlock means, the hinge means and the coupling means of section 36 (including serrated projections 70*a* and 72*c*) are structurally and functionally identical to those of section 34 for connection thereto.

This interconnection and coupling will now be described with reference to FIGS. 3, 9 and 10, each figure of which shows the track sections of the invention in various stages of assembly. FIG. 10, for example shows a plurality of interconnected track sections 34 with the sidewalls thereof in the unpivoted position with the track segment shown as a curve. FIG. 9 is an enlarged view of one track section 34 coupled to track sections shown in partial view, with one sidewall thereof in its pivoted position; while FIG. 3 illustrates two track sections 34 coupled to one track section 36 with the sidewalls thereof in the fully upright position, this position corresponding to that for use with the vehicle 30, as shown in FIG. 1.

Referring first to FIG. 10, there is shown a track segment formed of five track sections 34 with the sidewalls 34*b* and 34*c* in generally planar relation to the main body portions 34*a*. The sets of projections 40 and 43 of each section are interleaved with the sets of projections 42 and 43, respectively, with the serrated projections 40*a* and 41*c*, frictionally coacting with the serrated projections 42*a* and 43*c*. Similarly, the set 52 of projections on sidewall 34*b* are interleaved with the set 54 of projections with the barbs 52*d* and 54*d*, respectively, coacting to limit the amount of movement relative to one another. On the other sidewall 34*c*, the set 56 of projections are interleaved with the set 58 of projections of an adjacent track section 34. The hook member 48 of each track section 34 is coupled to the hook member 46 of an adjacent section with each hook member resting on the respective bearing surface 46*a* and 48*a* of the other hook member. As shown in FIG. 10, each section 34 is oriented at an angle to the adjacent section for the purpose of forming a curve, the pivoting taking place about the coupling hook member connection of hook members 46 and 48. The overall length of the projections is sufficient to accommodate this movement upon pivoting, while remaining interleaved. In FIG. 10, certain reference numerals are omitted for the sake of clarity and to avoid overcrowding of the drawing, but reference to FIGS. 5 and 6 may be had for completeness. With the track sections 34 coupled as shown, the upper surfaces of the main body portions 34*a* form a continuous roadway for the track segment, this roadway being better illustrated in FIG. 6 in end view in direction of travel of a vehicle thereon.

FIG. 9 shows an enlarged view of the coupling of adjacent track sections 34 with the sidewalls 34*c* thereof pivoted to the operative position, that is in a generally upright position transverse to the plane of the main body portion 34*a*. As previously described with reference to FIGS. 5 and 6, the sidewall 34*c* is pivoted about its hinge 62, with the flanges thereof coacting within the recess 66 in engagement with the shoulders thereof to interlock the sidewall 34*c* in generally transverse relation to the main body portion 34*a*. Similarly, the sidewall 34*b* is pivoted about its hinge 60 until the flanges 68*a* and 68*b* engage the recess 64 in locking relation with the shoulders 64*a* and 64*b* thereof.

The operative position of the sidewalls 34*b* and 34*c* (as well as 36*b* and 36*c*) with respect to the main body portion 34*a* (as well as main body portion 36*a*) is shown in FIG. 3, in which two track sections 34 are coupled to one transition track section 36 to form a track segment. The interleaving of the sets 56 and 58 of projections on the sidewalls 34*c* and 36*c* is best shown in FIG. 4, which also depicts the interleaving of the set 76 of projections of section 36 with the set 56 of projections of section 34. FIG. 3 illustrates the interleaving of the sets 70 and 72 of projections on the main body portion 36*a* of section 36 with the coacting sets 40 and 41 of projections of section 34, as well as the interleaving of the projections on the sidewalls 34*b* and 36*b*.

In accordance with the present invention there is shown and described a track section 34 which may be interconnected to any number of other like sections to form a continuous roadway for travel thereon of a miniature toy vehicle 30, with the roadway so formed having curves and slopes. By using the second track section 36, in conjunction with conventional track sections 20 and 22, a track system may be formed with straight sections formed of the conventional sections 20 and 22. Although there has been shown and described a preferred embodiment, various other adaptations and modifications may be made within the spirit and scope of the invention.

I claim:

1. A track section for interconnection with other like track sections for forming a roadway for travel thereover of toy vehicles, said track section comprising:

a unitary member formed of a generally flexible material in a generally planar arrangement and having a main body portion with first and second sidewall portions on the lateral edges thereof;

hinge means intermediate said main body portion and each of said sidewall portions for enabling pivoting of said sidewall portions into opposing relation to a position generally transverse to said main body portion;

interlock means on said main body portion and each of said sidewall portions for maintaining said sidewall portions in the generally transverse position; and means for coupling said track section to another track section having coacting coupling means for forming a roadway.

2. The track section of claim 1 wherein said means for coupling includes hook means integrally formed in said main body portion.

3. The track section of claim 2 wherein said means for coupling includes sets of projections extending longitudinally from the ends of each of said sidewall portions for interlocking with offset sets of projections on the sidewall portions of an adjacent track section.

4. The track section of claim 1 wherein said means for coupling includes hook means integrally formed in said main body portion on opposite ends on the longitudinal centerline thereof with sets of projections extending longitudinally from said ends, the sets of projections on one end being offset from the sets of projections on the other end for interlocking engagement with another like track section.

5. The track section of claim 4 wherein said means for coupling further includes sets of projections exending longitudinally from opposite ends of each of said sidewall portions for interlocking with offset sets of projections on the sidewall portions of adjacent like track sections.

6. The track section of claim 5 wherein at least some of the projections of said sets of projections are provided with friction means for coacting with like friction means on an interlocked projection of an adjacent track section.

7. The track section of claim 6 wherein said friction means includes coacting serrated surfaces.

8. The track section of claim 6 wherein said friction means includes barb means.

9. The track section of claim 6 wherein said friction means includes at least one of serrated surfaces and barb means on said at least some of said projections.

10. The track section of claim 6 wherein each of the projections of said sets of projections is dimensioned and configured for enabling relative pivoting of adjacent connected track sections about said hook means while maintaining interconnection for enabling the formation of curved roadways.

11. In a track system formed from a pluarlity of track sections for forming a roadway for travel thereover of toy vehicles, said track system having at least two identically configured one-piece track section, each of said track sections comprising:

a generally planar main body portion with first and second sidewall portions extending generally transverse to the plane of said main body portion in generally opposing relation generally parallel to the longitudinal centerline of said main body portion;

hook means on opposite ends of said main body portion on the longitudinal centerline thereof, said hook means being configured for engagement with hook means on an adjacent like track section; and friction means on at least one of said main body portion and said sidewall portions, said friction means being on opposing ends thereof for frictional engagement with like coacting friction means on an adjacent track section with said hook means inteconnected whereby to maintain said track sections in engagement; and said friction means includes interlocking coacting sets of projections which extend longitudinally from opposite ends of each sidewall portions.

12. In a track system formed from a plurality of track sections for forming a roadway for travel thereover of toy vehicles, said track system having at least two indentically configured track sections, each of said track sections comprising:

a generally planar main body portion with first and second sidewall portions extending generally transverse to the plane of said main body portion in generally opposing relation generally parallel to the longitudinal centerline of said main body portion;

hook means on opposite ends of said main body portion on the longitudinal centerline thereof, said hook means being configured for engagement with hook means on an adjacent like track section; and friction means on at least one of said main body portion and said sidewall portions, said friction means being on opposing ends thereof for frictional engagement with like coacting friction means on an adjacent tracks section with said hook means interconnected whereby to maintain said track sections in engagement, and said friction means includes sets of projections extending longitudinally from opposite ends of said main body portion and each of said sidewall portions, the sets of projections on one end being offset from the sets of projections on the other end for enabling interlocking engagment of said sets of projections when connected to another like track section.

13. The track system of claim 12 wherein each projection of said sets of projections is dimensioned and configured for enabling relative pivoting of adjacent connected track sections about said hook means while maintaining interconnection for enabling the formation of curved roadways.

* * * * *